US011682343B2

(12) United States Patent
Cheng et al.

(10) Patent No.: US 11,682,343 B2
(45) Date of Patent: Jun. 20, 2023

(54) DISPLAY DRIVER

(71) Applicant: Novatek Microelectronics Corp., Hsinchu (TW)

(72) Inventors: Jhih-Siou Cheng, New Taipei (TW); Chun-Fu Lin, Taoyuan (TW); Tung-Shuan Cheng, Hsinchu County (TW); Po-Hsiang Fang, Hsinchu County (TW); Ju-Lin Huang, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 17/726,558

(22) Filed: Apr. 22, 2022

(65) Prior Publication Data

US 2022/0343837 A1 Oct. 27, 2022

Related U.S. Application Data

(60) Provisional application No. 63/178,540, filed on Apr. 23, 2021.

(51) Int. Cl.
*G09G 3/32* (2016.01)

(52) U.S. Cl.
CPC ..... *G09G 3/32* (2013.01); *G09G 2310/08* (2013.01); *G09G 2320/0247* (2013.01)

(58) Field of Classification Search
CPC ..... G09G 3/32; G09G 2320/0247; G09G 2310/08; G09G 2300/06; G09G 3/2025
See application file for complete search history.

(56) References Cited

U.S. PATENT DOCUMENTS

| | | | | |
|---|---|---|---|---|
| 9,905,159 | B2 | 2/2018 | Genoe | |
| 2005/0017993 | A1* | 1/2005 | Choi | G09G 3/2014 345/691 |
| 2015/0302795 | A1 | 10/2015 | Genoe | |
| 2017/0090630 | A1* | 3/2017 | Kim | G06F 3/0443 |
| 2020/0211481 | A1* | 7/2020 | Lee | G09G 3/3648 |
| 2022/0189383 | A1* | 6/2022 | Choi | G09G 3/2092 |

FOREIGN PATENT DOCUMENTS

| | | |
|---|---|---|
| CN | 111554234 | 8/2020 |
| TW | 201426710 | 7/2014 |

OTHER PUBLICATIONS

"Office Action of Taiwan Counterpart Application", dated Feb. 8, 2023, p. 1-p. 6.

* cited by examiner

*Primary Examiner* — Muhammad N Edun
(74) *Attorney, Agent, or Firm* — JCIPRNET

(57) ABSTRACT

A display driver for driving a display device including a pixel array is provided. The display driver includes a plurality of driving channels. The driving channels is configured to output driving signals in a pulse width modulation manner to drive the pixel array to illuminate in a first frame period which is being divided into a plurality of subframe periods. A first driving channel of the plurality of driving channels outputs a first driving signal in a first subframe period combination. A second driving channel of the plurality of driving channels outputs a second driving signal in a second subframe period combination different than the first subframe period combination. Each of the first subframe period combination and the second subframe period combination comprises at least one subframe period of the first frame period.

15 Claims, 9 Drawing Sheets

DISPLAY DRIVER

This application claims the priority benefit of U.S. Provisional Application No. 63/178,540, filed on Apr. 23, 2021. The entirety of the above-mentioned patent application is hereby incorporated by reference herein and made a part of this specification.

BACKGROUND

Technical Field

The disclosure generally relates to a display driver, in particular, to a display driver outputting driving signals in a pulse width modulation manner.

Description of Related Art

A conventional display driver for driving a light emitting diode (LED) display device drives each pixel in the pixel array of a display panel by outputting a driving signal corresponding to a pixel data (grayscale value) as a constant-current pulse width modulation (PWM) signal to each pixel in the pixel array during each frame period, and the pulse width of the driving signal controls the time length each pixel keeps illuminating for. In this regard, a driving signal having a short pulse leads to a short bright but also long dark pixel in a frame period. Especially, in the case of low pixel data, the problem of display flicker is more obvious. However, conventional solution just divides a frame period into subframe periods and let the display driver drive the entire pixel array to emit light evenly in these subframe periods. The traditional solution still has the problem of obvious screen flickering in the case of extreme low pixel data.

SUMMARY

The disclosure is directed to a display driver capable of providing effective display driving function.

A display driver for driving a display device including a pixel array of an embodiment of the disclosure includes a plurality of driving channels. The plurality of driving channels are configured to output driving signals in a pulse width modulation manner to drive the pixel array to illuminate in a first frame period which is being divided into a plurality of subframe periods. The first driving channel of the plurality of driving channels outputs a first driving signal in a first subframe period combination. A second driving channel of the plurality of driving channels outputs a second driving signal in a second subframe period combination different than the first subframe period combination. Each of the first subframe period combination and the second subframe period combination comprises at least one subframe period of the first frame period.

A display driver for driving a display device including a pixel array of an embodiment of the disclosure includes a plurality of driving channels. The plurality of driving channels are configured to output driving signals in a pulse width modulation manner to drive the pixel array to illuminate in a first frame period which is being divided into a plurality of subframe periods. Each of the plurality of subframe periods is being divided into a plurality of scan line periods. A first driving channel of the plurality of driving channels outputs driving signals to pixels in a first scan line period combination of a first subframe period of the first frame period. The first driving channel outputs driving signals in a second scan line period combination of a second subframe period of the first frame period. A number of scan line periods of the first scan line period combination or the second scan line period combination is less a number of the plurality of scan line periods. Each of the first scan line period combination and the second scan line period combination includes at least one scan line period.

Based on the above, according to the display driver of the disclosure, the display driver can effectively drive the display device to reduce the flickering effect.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
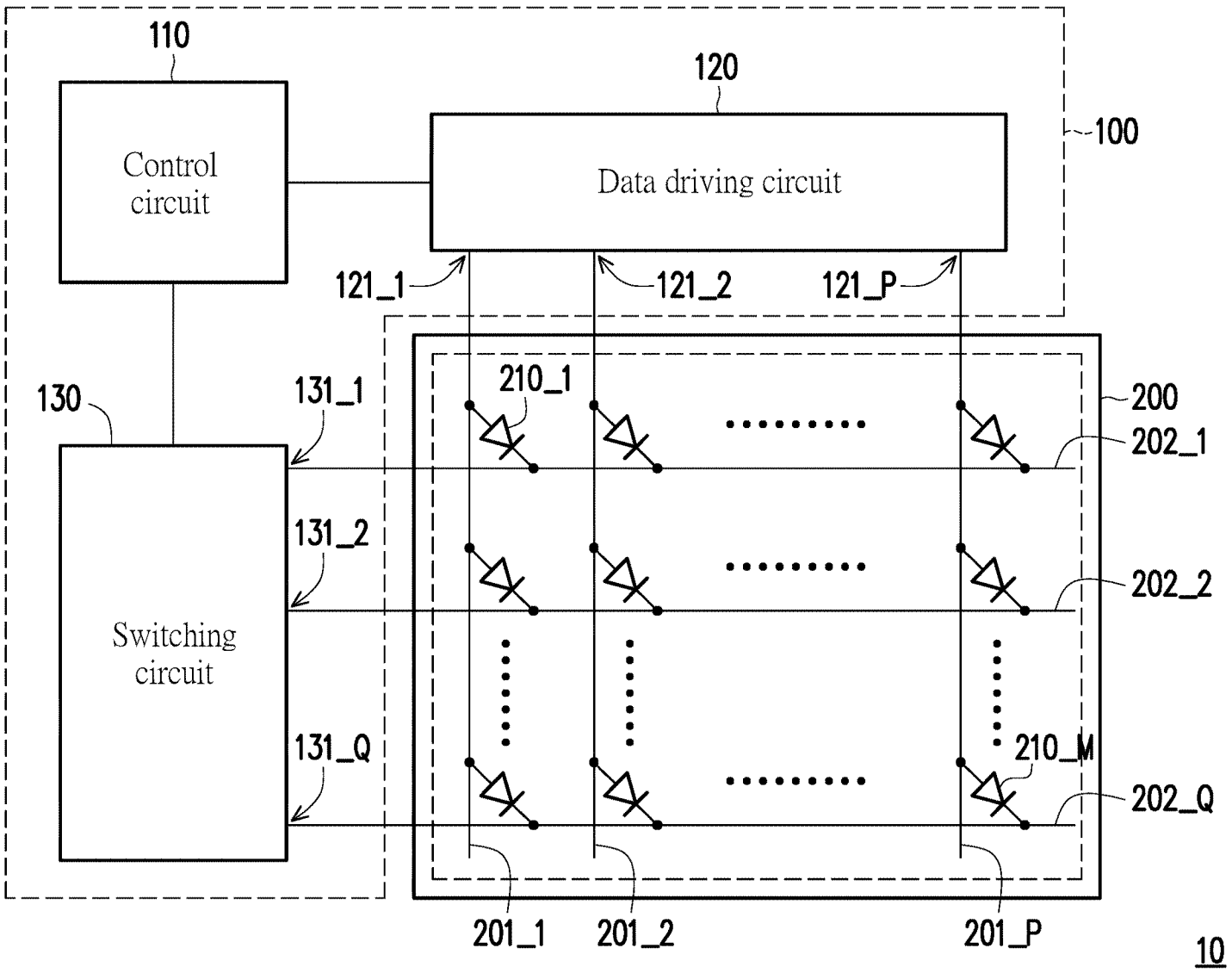
FIG. 1 is a schematic diagram of a display device according to an embodiment of the disclosure.

The term "couple (or connect)" throughout the specification (including the claims) of this application are used broadly and encompass direct and indirect connection or coupling means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain coupling means. In addition, terms such as "first" and "second" mentioned throughout the specification (including the claims) of this application are only for naming the names of the elements or distinguishing different embodiments or scopes and are not intended to limit the upper limit or the lower limit of the number of the elements not intended to limit sequences of the elements. Moreover, elements/components/steps with same reference numerals represent same or similar parts in the drawings and embodiments. Elements/components/notations with the same reference numerals in different embodiments may be referenced to the related description.

FIG. 1 is a schematic diagram of a display device according to an embodiment of the disclosure. Referring to FIG. 1, display device 10 includes the display driver 100 and a pixel array 200. The pixel array 200 includes a plurality of pixels 210_1~210_M, where M is a positive integer. In the embodiment of the disclosure, the display device 10 may be a light emitting diode (LED) display device, a micro LED display device or a mini LED display device. Each of the pixels 210_1~210_M may be a LED, a micro LED or a mini LED. The display driver 100 is configured to drive the pixel array 200 of the display device 10 to perform display function. In the embodiment of the disclosure, the display driver 100 includes a control circuit 110, a data driving circuit 120, and a switching circuit 130. The control circuit 110 is coupled to the data driving circuit 120 and the switching circuit 130. The data driving circuit 120 includes a plurality of driving channels 121_1~121_P, where P is a positive integer. The driving channels 121_1~121_P are respectively coupled to a plurality of columns of the pixel array 200 through a plurality of data lines 201_1~201_P. The data driving circuit 120 may behave as a constant current driver and each of the driving channels 121_1~121_P may output driving signals in a pulse width modulation (PWM) manner with a constant current. The switching circuit 130 includes a plurality of switch units and a plurality of switching channels 131_1~131_Q, where Q is a positive integer. The switching channels 131_1~131_Q are coupled to a plurality of rows of the pixel array 200 through a plurality of scan lines 202_1~202_Q. The switch units may be a plurality of switch transistor coupled to the switching channels 131_1~131_Q respectively, and for determining whether the switching channels 131_1~131_Q are connected to ground so that the corresponding pixels are operated in a driving state respectively.

In the embodiment of the disclosure, the control circuit 110 is configured to control the data driving circuit 120 to output driving signals in in the PWM manner to drive the pixel array 200, and provide a plurality of switching signals to control the switch units of the switching circuit 130. For example, if the switching channel 131_1 is connected to ground by corresponding switch unit being turned on by corresponding switching signal, the pixel 210_1 can be drive to illuminate when the pixel 210_1 receives a driving signal form the driving channel 121_1. Otherwise, if the switching channel 131_1 is open-circuited due to a corresponding switch unit being cut off, the pixel 210_1, a pixel row controlled by the switching channel 131_1 is open-circuited. The driving channel 121_1 may outputs the driving signal in the PWM manner to drive the pixel 210_1 to illuminate in a frame period which is being divided into a plurality of subframe periods. The total pulse width of the driving signal in the frame period is equal to the length of time that the pixel 210_1 is lit, which is determined by the grayscale data of the pixel 210_1 to be displayed. Furthermore, the pulse width of the driving signal during the frame period may be divided to a plurality of sub-pulse widths to correspond to the different subframe periods respectively.

In the embodiment of the disclosure, the display driver 100 may divide the pulse width of a driving signal generated according to pixel data of a pixel to a plurality of sub-pulse widths and respectively output the driving signal of the sub-pulse widths in some subframe periods among one frame period, so as to drive the pixel during different subframe periods respectively to effectively reduce the time length of non-illuminating time interval between different frames. Moreover, the display driver 100 may further drive different pixels of the pixel array 200 according to different subframe period combinations during the different subframe periods of one frame period, like a spatially alternative manner while illuminating among pixels of pixel array 200, so as to effectively reduce flicker phenomenon.

Figure 2:
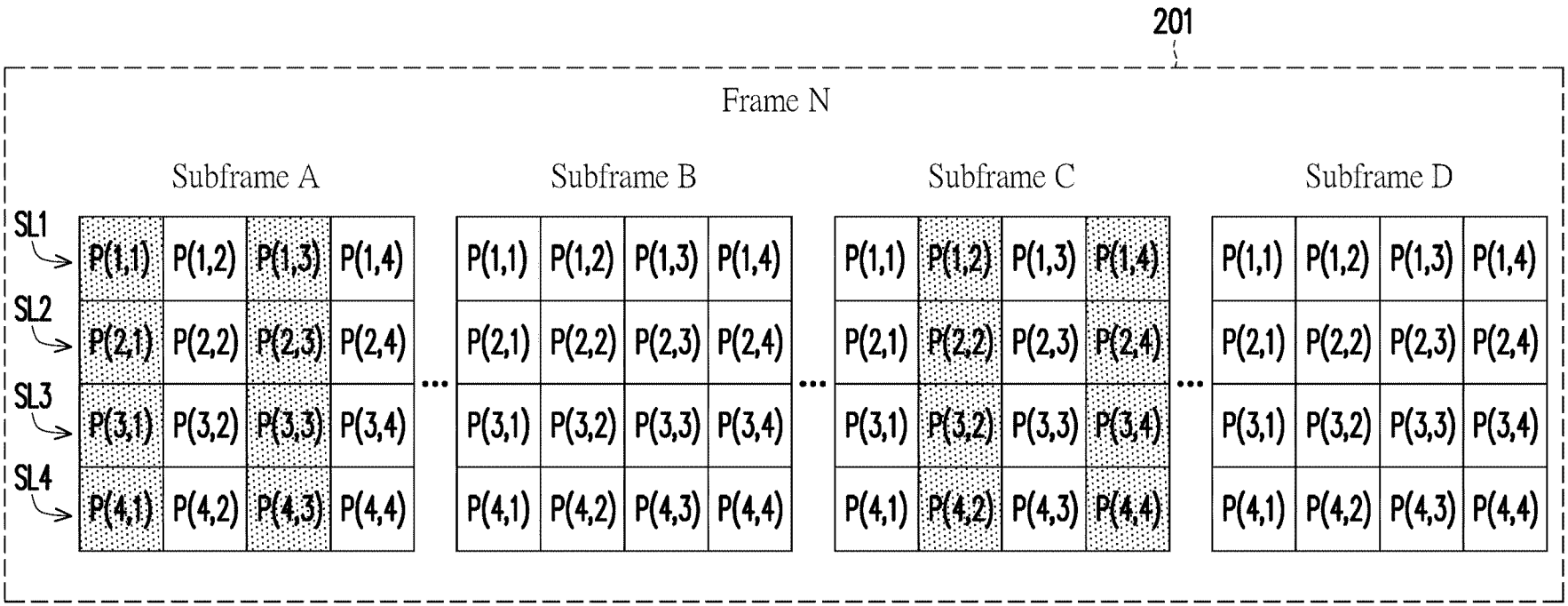
FIG. 2 is a schematic diagram of driving a pixel array of the display device during a plurality of subframe periods of the Nth frame period according to an embodiment of the disclosure.

FIG. 2 is a schematic diagram of driving a pixel array of the display device during a plurality of subframe periods of the Nth frame period according to an embodiment of the disclosure, where N is a positive integer. In the figures of the present disclosure, a frame period is denoted as a frame in short and a subframe period is denoted as a subframe in short. Each subframe period includes a plurality of scan line periods, and each pixel row is able to be driven in a corresponding scan line period. Referring to FIG. 1 and FIG. 2, taking 16 pixels in the pixel array 200 as an example, the pixels P(1,1)~P(4,4) are a 4*4 pixel array defined by first to fourth columns and first to fourth rows of pixels of the pixel array 200. The first to fourth pixel rows are able to be driven in different scan line periods denoted by SL1 to SL4, which are denoted in FIG. 2 and omitted in other figures. In the embodiment of the disclosure, the display driver 100 may drive the pixels P(1,1)~P(4,4) in the Nth frame period 201 (frame period N). The driving channels 121_1~121_4 of data driving circuit 120 may output driving signals in the pulse width modulation manner to drive the pixels P(1,1)~P(4,4) to illuminate in the Nth frame period 201 which is being divided into, for example, 32 subframe periods, but the disclosure is not limited thereto. Most examples in the present disclosure are given based on the assumption of each frame period being divided into 32 subframe periods. In FIG. 2 and following figures, a pixel remarked by dot pattern represents it is a pixel allowed to illuminate (as long as the corresponding grayscale value is not zero), driven by a driving signal in a corresponding scan line period of a subframe period, no matter the pulse width of the driving signal distributed in the corresponding scan line period is a full or partial pulse width. In fact, whether a pixel illuminates or not is decided by the grayscale value (pixel data). As show in FIG. 2, the subframe period A may correspond to the first subframe period of 32 subframe periods the frame period 201, or a subframe period among the first to the eighth subframe periods of the 32 subframe periods. The subframe period B may correspond to the ninth subframe period (or a subframe period among the ninth to the sixteenth subframe periods which keeps eight subframe periods long from the subframe period A). The subframe period C may correspond to the seventeenth subframe period (or a subframe period among the seventeenth to the twenty-fourth subframe periods which keeps eight subframe periods long from the subframe period B). The subframe period D may correspond to the twenty-fifth subframe period (or a subframe period among the twenty-fifth to the thirty-second subframe periods which keeps eight subframe periods long from the subframe period C).

In the embodiment of the disclosure, there are at least two driving channels driven in different subframe period combinations. One or more subframe periods of the 32 subframe periods may be selected to form a subframe period combination. In the embodiment of FIG. 2, each of the driving channel 121_1 and the driving channel 121_3 (odd driving channels) may output driving signals in a first subframe period combination which may include only one subframe period such as the subframe period A (1' subframe period), and its pixel driving result (pixel illuminating result) may be displayed in the subframe period A, and each of the driving channel 121_2 and the driving channel 121_4 (even driving channels) may output driving signals in a second subframe period combination which may include only one subframe period such the subframe period C ($17^{th}$ subframe period), and its pixel driving result may be displayed in the subframe period C. In the embodiment of FIG. 2 of the disclosure, each of the driving channel 121_1 and the driving channel 121_3 (odd driving channels) may respectively output driving signals in each scan line period (or called a horizontal line period) of the first subframe period (subframe period A) of the first subframe period combination, and the driving channel 121_2 and the driving channel 121_4 (even driving channels) may respectively output driving signals in each scan line period of the seventeenth subframe period (subframe period C) of the second subframe period combination.

In other words, regarding to the pixels P(1,1), P(2,1), P(3,1), P(4,1), P(1,3), P(2,3), P(3,3) and P(4,3), the driving channel 121_1 and the driving channel 121_3 responsible for driving the pixel column including the pixels P(1,1), P(2,1), P(3,1) and P(4,1) and the pixel column including the pixels P(1,3), P(2,3), P(3,3) and P(4,3) in the frame period 201 output the driving signals to the pixels P(1,1), P(2,1), P(3,1), P(4,1), P(1,3), P(2,3), P(3,3) and P(4,3) in the first subframe period combination consisting of only one subframe period (subframe period A), and in the aspect of subframe periods, the first subframe period combination is assigned to the driving channel 121_1 and the driving channel 121_3. Regarding to the pixels P(1,2), P(2,2), P(3,2), P(4,2), P(1,4), P(2,4), P(3,4) and P(4,4), the driving channel 121_2 and the driving channel 121_4 responsible for driving the pixel column including the pixels P(1,2), P(2,2), P(3,2) and P(4,2) and the pixel column including the pixels P(1,4), P(2,4), P(3,4) and P(4,4) in the frame period 201 output the driving signals to the pixels P(1,2), P(2,2), P(3,2), P(4,2), P(1,4), P(2,4), P(3,4) and P(4,4) in the second subframe period combination consisting of only one subframe period (subframe period C), and in the aspect of subframe periods, the second subframe period combination is assigned to the driving channel 121_2 and the driving channel 121_4.

Thus, the pixels P(1,1), P(2,1), P(3,1), P(4,1), P(1,3), P(2,3), P(3,3) and P(4,3) may be driven to illuminate, or more precisely, allowable to be driven by the driving signal in the first subframe period, and the pixels P(1,2), P(2,2), P(3,2), P(4,2), P(1,4), P(2,4), P(3,4) and P(4,4) may be driven to illuminate in the seventeenth subframe period, or more precisely, allowable to be driven by the driving signal. That is, the display driver 100 may drive the pixel array 200 during a continuous frame period, and driving result of each frame period can be like the Nth frame period 201. Therefore, the display refresh rate of the pixel array 200 may be doubled compared to displaying a picture during each entire frame period, so as to effectively reduce the image flickering.

Figure 3:
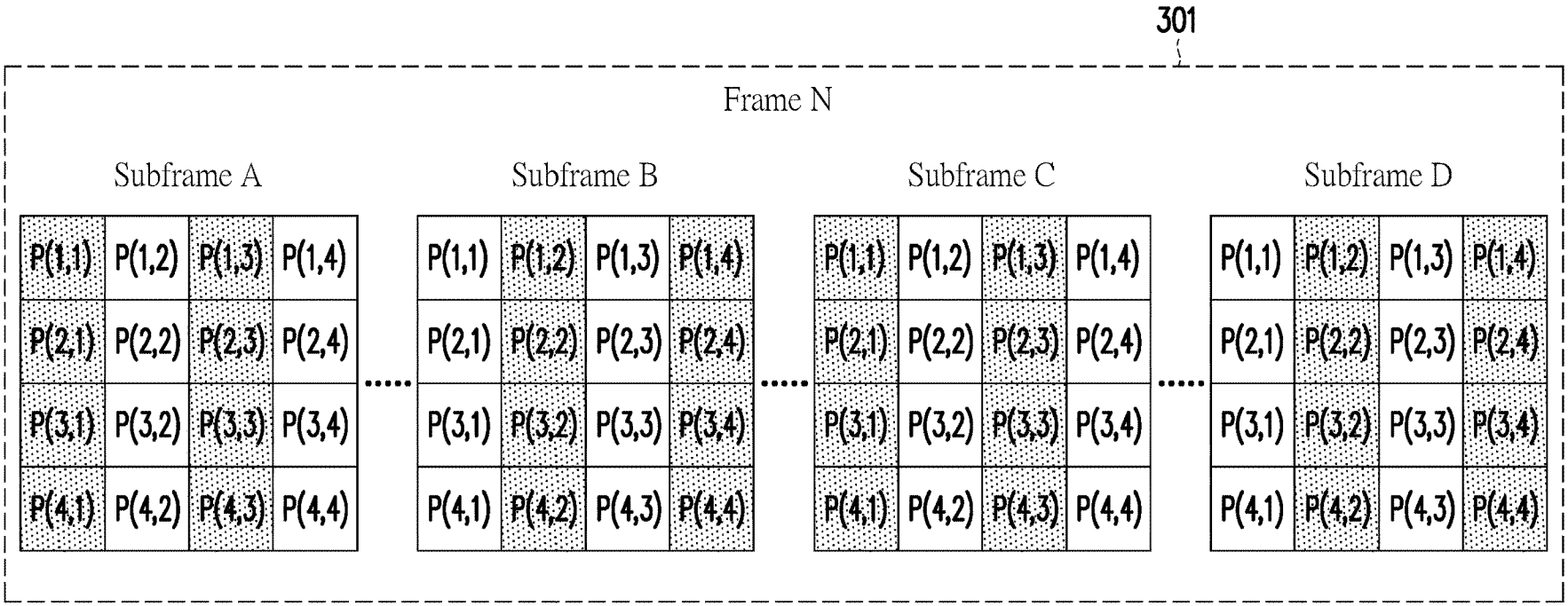
FIG. 3 is a schematic diagram of driving the pixel array of the display device during a plurality of subframe periods of the Nth frame period according to another embodiment of the disclosure.

FIG. 2 is illustrated based on an assumption that the pixel data of each pixel may be a grayscale value low enough such that its corresponding driving signal with the entire pulse width can be completely output during one subframe period to drive the pixel and may not necessary to divide the pulse width of the driving signal to several partial pulse widths. However, as long as the grayscale value of the pixel is not corresponding to a pulse width not able to be divided, such as grayscale value '1' among 0 to 65535, the corresponding pulse width of the driving signal may be divided to be output in at least two subframe periods, and FIG. 3 illustrates such a condition. FIG. 3 is a schematic diagram of driving the pixel array of the display device during a plurality of subframe periods of the Nth frame period according to another embodiment of the disclosure. Referring to FIG. 1 and FIG. 3, different from the embodiment of FIG. 2, the first subframe period combination, which is selected from subframe periods of a frame period 301, may include two subframe periods A and C ($1^{st}$ and $17^{th}$ subframe periods), and the second subframe period combination, which is selected from the subframe periods of the frame period 301, may include two subframe periods B and D ($9^{th}$ and $25^{th}$ subframe periods), different from the first subframe period combination. In another embodiment, the number of subframes periods in a subframe period combination is not limited to two but more subframes periods. In the embodiment of FIG. 3, each of the driving channel 121_1 and the driving channel 121_3 (odd driving channels) may output a driving signal to a pixel in the first subframe period combination including the subframe periods A and C and its pixel driving result may be displayed in at least one of the subframe periods A and C, and each of the driving channel 121_2 and the driving channel 121_4 (even driving channels) may output a driving signal in the second subframe period combination including the subframe period B and D, and its pixel driving result may be displayed in at least one of the subframe periods B and D. In the embodiment of FIG. 3 of the disclosure, each of the driving channel 121_1 and the driving channel 121_3 may respectively output driving signals in each scan line period of at least one subframe period of the first subframe period combination, and the driving channel 121_2 and the driving channel 121_4 may respectively output driving signals in each scan line period of at least one subframe period of the second subframe period combination. It should be noted that, the entire pulse width of each above driving signal are being divided into partial pulse widths such as two or more partial pulse widths being respectively output in the two or more subframe periods of the corresponding subframe period combination. In the embodiment of the disclosure, the two or more subframe periods of the each subframe period combination may be alternately distributed in the frame period 301. Therefore, by reducing a non-illuminating interval (in which no pixels of the pixel array illuminates) between two subframe periods in which a part of pixels of the pixel array are allowed to illuminate, the display refresh rate of the pixel array 200 may be increased, so as to effectively reduce the flicker phenomenon.

In addition, in one embodiment of the disclosure, the driving channel 121_1 and the driving channel 121_3 responsible for outputting driving signals to the pixels P(1,1), P(2,1), P(3,1), P(4,1), P(1,3), P(2,3), P(3,3) and P(4,3), may output the driving signals in the first subframe period combination in response to the control circuit 110 respectively determines the pixel data of the pixels P(1,1), P(2,1), P(3,1), P(4,1), P(1,3), P(2,3), P(3,3) and P(4,3) are lower than a predetermine grayscale value, wherein the driving signals may be associated with non-zero grayscale value. The driving channel 121_2 and the driving channel 121_4 responsible for outputting driving signals to the pixels P(1,2), P(2,2), P(3,2), P(4,2), P(1,4), P(2,4), P(3,4) and P(4,4), may output the driving signals in the second subframe period combination in response to the control circuit 110 respectively determines the pixel data of the pixels P(1,2), P(2,2), P(3,2), P(4,2), P(1,4), P(2,4), P(3,4) and P(4,4) are lower than a predetermine grayscale value.

Figure 4:
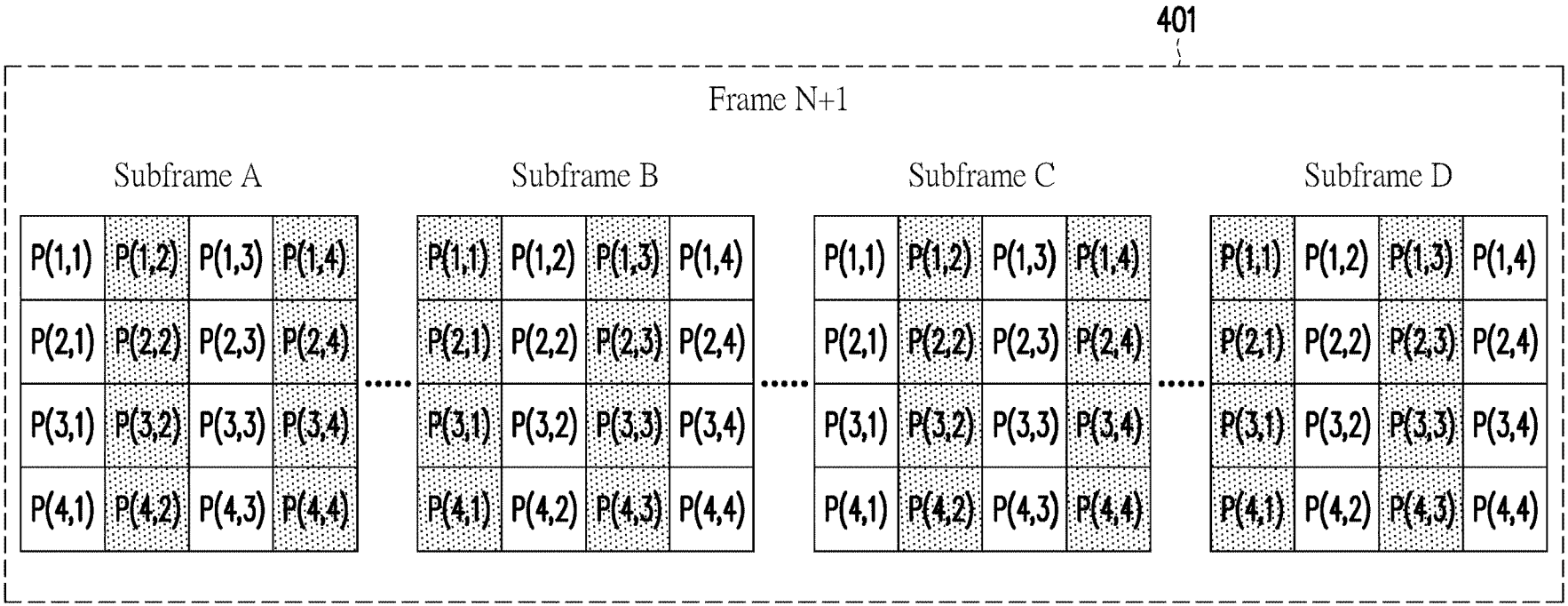
FIG. 4 is a schematic diagram of driving the pixel array of the display device during a plurality of subframe periods of the (N+1)th frame period according to an embodiment of the disclosure.

FIG. 4 is a schematic diagram of driving the pixel array of the display device during a plurality of subframe periods of the (N+1)th frame period according to an embodiment of the disclosure. Referring to FIG. 1, FIG. 3 and FIG. 4, in the (N+1)th frame period which is next to the frame period 301 of FIG. 3, the control circuit 110 may change arrangement of the first subframe period combination and the second subframe period combination. In the embodiment of the disclosure, regarding to the pixels P(1,1), P(2,1), P(3,1), P(4,1), P(1,3), P(2,3), P(3,3) and P(4,3), the driving channel 121_1 and driving channel 121_3 responsible for driving the pixels P(1,1), P(2,1), P(3,1), P(4,1), P(1,3), P(2,3), P(3,3) and P(4,3) may output driving signals to the pixels P(1,1), P(2,1), P(3,1), P(4,1), P(1,3), P(2,3), P(3,3) and P(4,3) in the first subframe period and seventeen subframe period of the first subframe period combination of the frame period 301, and may output another driving signals to the pixels P(1,1), P(2,1), P(3,1), P(4,1), P(1,3), P(2,3), P(3,3) and P(4,3) in the ninth subframe period and the twenty-fifth subframe period of the second subframe period combination of the frame period 401.

Furthermore, regarding to the pixels P(1,2), P(2,2), P(3,2), P(4,2), P(1,4), P(2,4), P(3,4) and P(4,4), the driving channel 121_2 and driving channel 121_4 responsible for driving the pixels P(1,2), P(2,2), P(3,2), P(4,2), P(1,4), P(2,4), P(3,4) and P(4,4) may output driving signals to the pixels P(1,2), P(2,2), P(3,2), P(4,2), P(1,4), P(2,4), P(3,4) and P(4,4) in the ninth subframe period and the twenty-fifth subframe period of the first subframe period combination of frame period of the frame period 301, and may output another driving signals to the pixels P(1,2), P(2,2), P(3,2), P(4,2), P(1,4), P(2,4), P(3,4) and P(4,4) in the first subframe period and seventeen subframe period of the second subframe period combination of the frame period 401.

That is, at least one driving channel may drive the corresponding pixel column of the pixel array 200 by using a different subframe period combination in a subsequent frame, and in other words, at least one driving channel may drive the corresponding pixel column of the pixel array 200 by not always using the same subframe period combination in continuous frame periods. As such, driving result of each adjacent two frame periods can be like the frame period 301 and the frame period 401. Therefore, the display refresh rate of the pixel array 200 may be increased, and the flicker phenomenon may be eliminated by using different subframe period combinations in different frame period.

Figure 5:
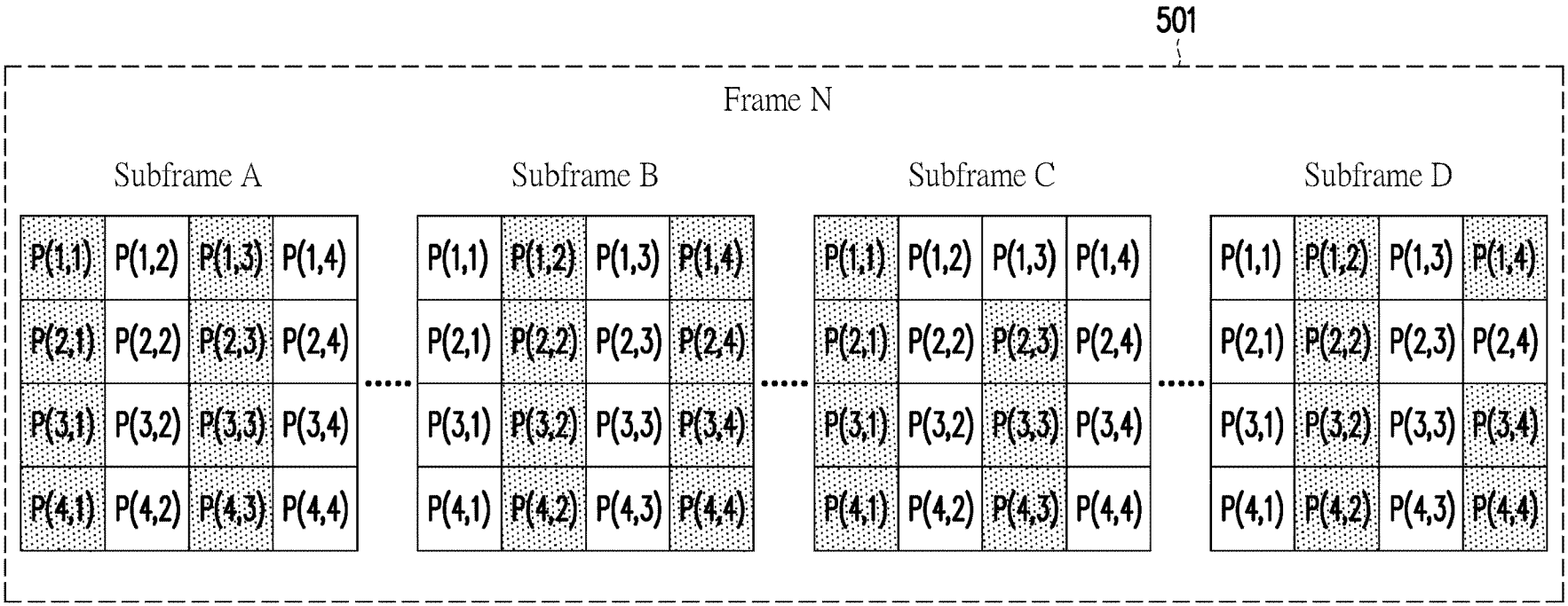
FIG. 5 is a schematic diagram of driving the pixel array of the display device during a plurality of subframe periods of the Nth frame period according to another embodiment of the disclosure.

As mentioned previously, as long as the grayscale value of the pixel is not corresponding to a pulse width no way to be divided, such as grayscale value '1' among 0 to 65535, the corresponding pulse width of the driving signal may be divided to be output in at least two subframe periods. The control circuit 110 may be able to determine whether a driving channel output a driving signal corresponding to a grayscale value by a continuous full pulse width or several partial pulse widths even though the grayscale value is determined low enough. FIG. 5 is a schematic diagram of driving the pixel array of the display device during a plurality of subframe periods of the Nth frame according to another embodiment of the disclosure. As shown in FIG. 5, the control circuit 110 determines the pixel data of the pixel P(1,3) and the pixel P(2,4) are ultra-low grayscale value and it's not necessary (or no way) to divide the pulse width of the driving signals corresponding to the pixel P(1,3) and the pixel P(2,4), such that the driving channels drive pixel P(1,3) in only one subframe period of the frame period 501, and drive pixel P(2,4) in only one subframe period of the frame period 501.

Figure 6:
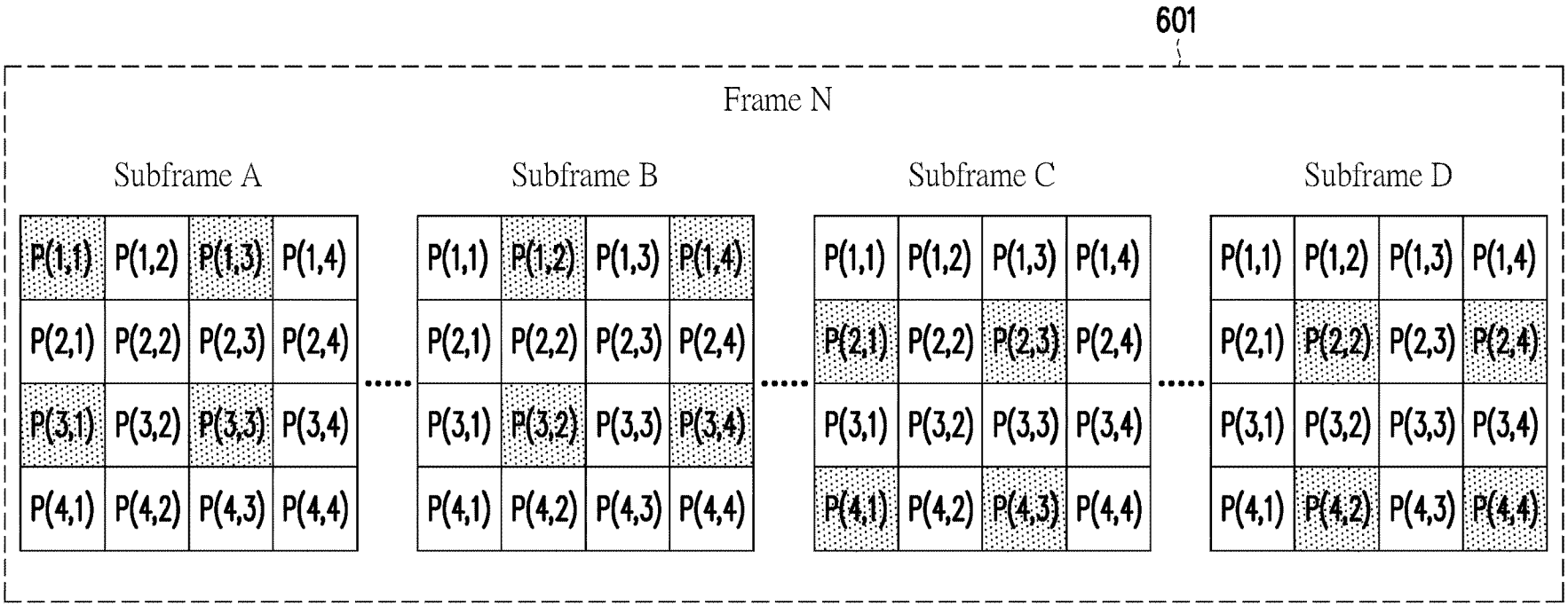
FIG. 6 is a schematic diagram of driving the pixel array of the display device during a plurality of subframe periods of the Nth frame period according to another embodiment of the disclosure.

FIG. 6 is a schematic diagram of driving the pixel array of the display device during a plurality of subframe periods of the Nth frame according to another embodiment of the disclosure. Referring to FIG. 1 and FIG. 6, different from the embodiment of FIG. 3, the control circuit 110 may further control the switching circuit 130 and the data driving circuit 120 to merely drive a part of pixel rows during each subframe period of each subframe period combination. In the embodiment of the disclosure, as shown as the frame period 601 in FIG. 6, the control circuit 110 may control the driving channel 121_1 and driving channel 121_3 of the data driving circuit 120 to be able to output corresponding driving signals in odd scan line periods of the first subframe period (subframe period A) of the first subframe period combination, and to be able to output corresponding driving signals in even scan line periods of seventeenth subframe (subframe period C) of the first subframe period combination. The control circuit 110 may control the driving channel 121_2 and driving channel 121_4 of the data driving circuit 120 to be able to output corresponding driving signals in odd (or even) scan line periods of the ninth subframe period (subframe period B) of the second subframe period combination, and to be able to output corresponding driving signals in even (or odd) scan line periods of twenty-fifth subframe period (subframe period D) of the second subframe period combination. Moreover, the driving channel 121_2 and the driving channel 121_4 do not output driving signals in each subframe periods of the first subframe period combination (subframe periods A and C), and the driving channel 121_1 and the driving channel 121_3 do not output driving signals in each subframe periods of the second subframe period combination (subframe periods B and D).

Figure 7:
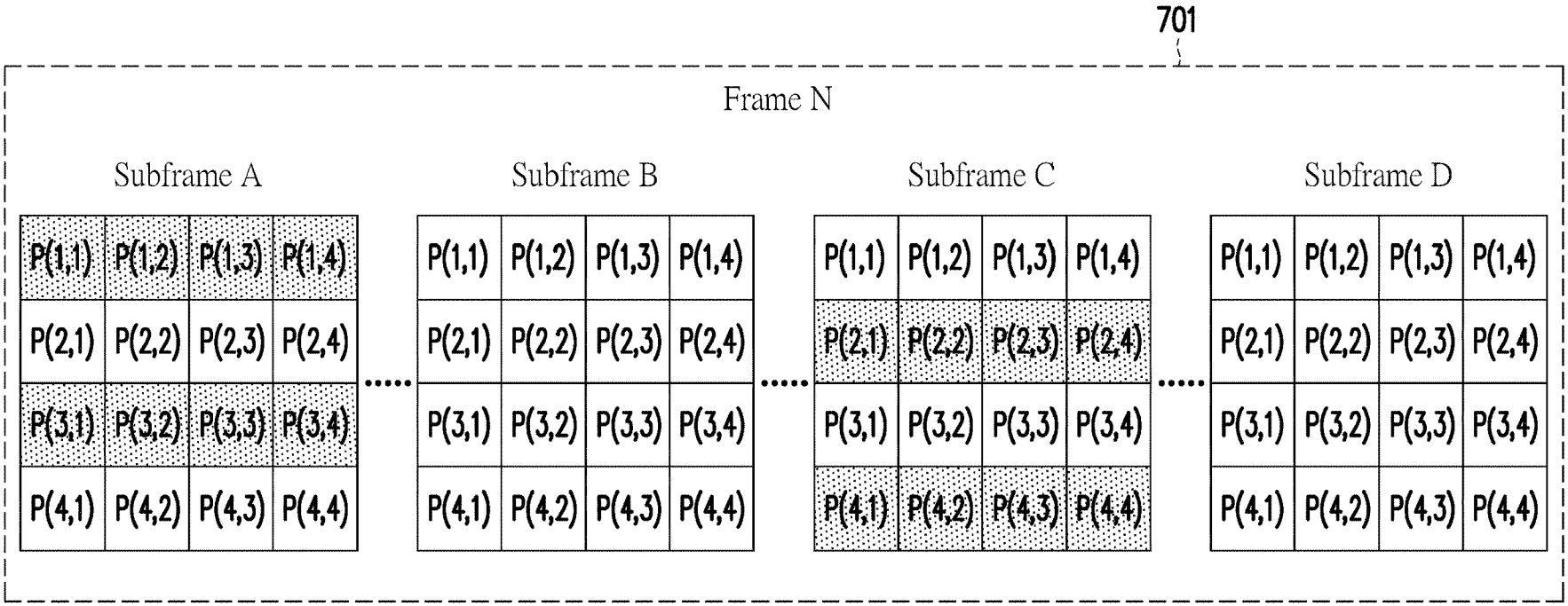
FIG. 7 is a schematic diagram of driving the pixel array of the display device during a plurality of subframe periods of the Nth frame period according to another embodiment of the disclosure.

FIG. 7 is a schematic diagram of driving the pixel array of the display device during a plurality of subframe periods of the Nth frame period according to another embodiment of the disclosure. Referring to FIG. 1 and FIG. 7, different from the embodiment of FIG. 2, each of the subframe periods may be further divided into a plurality of scan line periods. Each scan line period is a period in which a corresponding scan line is conducted. In the embodiment of the disclosure, different groups of the pixel rows of the pixel array are driven in different scan line periods. A scan line period combination includes scan line periods which are not continuous in time, and the number of scan line periods in anyone scan line period combination is less than the number of the plurality of scan line periods of a subframe period. In the embodiment of the disclosure, the driving channel 121_1~121_4 (all driving channel), which are responsible for driving all pixel of each adjacent column, may respectively output driving signals in the first scan line period combination (e.g. odd scan line periods) of the first subframe period (subframe period A), and the driving channels 121_2~121_4 (all driving channel) may respectively output driving signals in the second scan line period combination (e.g. even scan line periods) of the seventeenth subframe period (subframe period C).

Thus, the pixels P(1,1), P(1,2), P(1,3), P(1,4), P(3,1), P(3,2), P(3,3) and P(3,4) may be turned on to illuminate in the first subframe period (subframe period A), and the pixels P(2,1), P(2,2), P(2,3), P(2,4), P(4,1), P(4,2), P(4,3) and P(4,4) may be turned on to illuminate in the seventeenth subframe period (subframe period C). According to tis embodiment, a non-illuminating interval (in which no pixels of the pixel array illuminates) between two subframe periods (such as subframe periods A and C) in which different group of pixel rows of the pixel array illuminate, thus the display refresh rate of the pixel array 200 may be also increased, so as to effectively reduce the flicker phenomenon.

Figure 8:
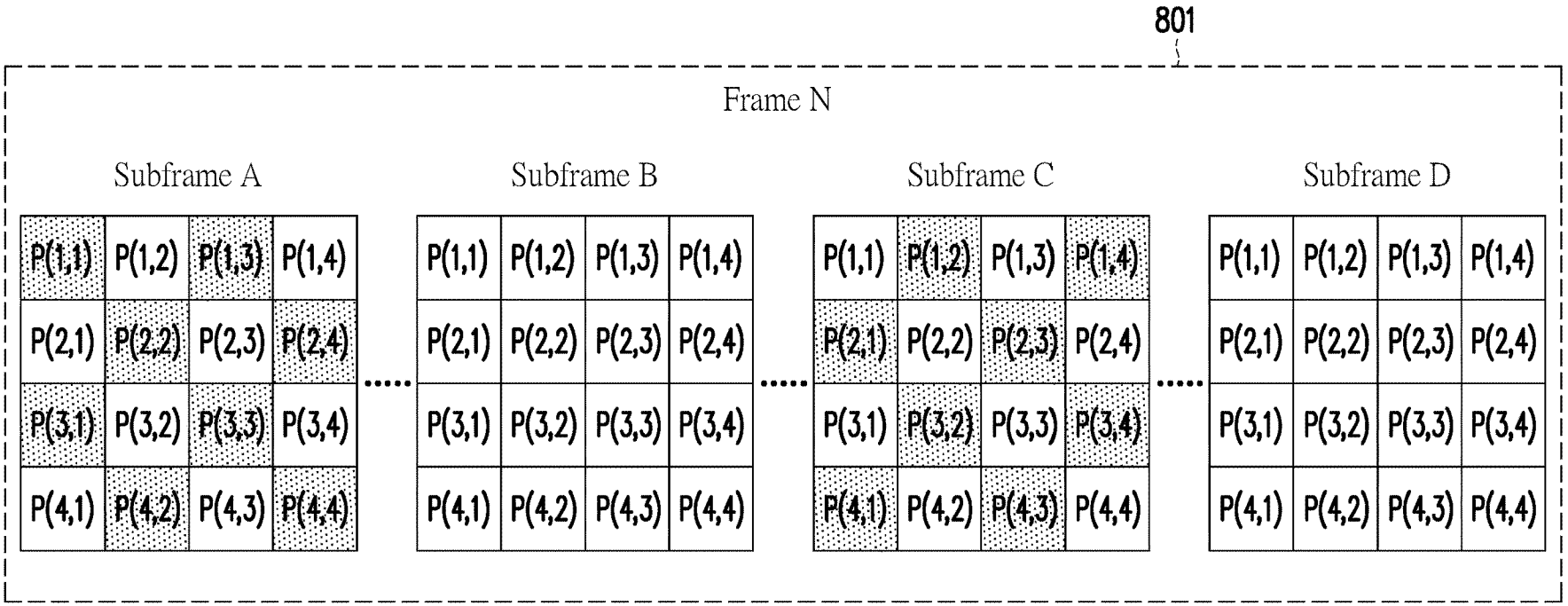
FIG. 8 is a schematic diagram of driving the pixel array of the display device during a plurality of subframe periods of the Nth frame period according to another embodiment of the disclosure.

FIG. 8 is a schematic diagram of driving the pixel array of the display device during a plurality of subframe periods of the Nth frame according to another embodiment of the disclosure. Referring to FIG. 1 and FIG. 8, different from the embodiment of FIG. 7, the each adjacent driving channel respectively output driving signals in different scan line period combinations. In the embodiment of the disclosure, the driving channel 121_1 and the driving channel 121_3, which are responsible for driving a first pixel column and a third pixel column, may output driving signals in the first scan line period combination (e.g. odd scan line periods) of the subframe period A of the frame period 801, and the driving channel 121_2 and the driving channel 121_4 responsible for driving a second pixel column adjacent to the first pixel column and a fourth pixel column adjacent to the third pixel column may not output driving signals in the first scan line period combination of the subframe period A of the frame period 801. The driving channel 121_2 and the driving channel 121_4 may output driving signals in the second scan line period combination (e.g. even scan line periods) of the subframe period A of the frame period 801, and the driving channel 121_1 and the driving channel 121_3 may not output driving signals in the second scan line period combination of the subframe period A of the frame period 801.

Furthermore, the driving channel 121_2 and the driving channel 121_4 may output driving signals in the third scan line period combination of the subframe period C of the frame period 801, and the driving channel 121_1 and the driving channel 121_3 may not output driving signals in the third scan line period combination of the subframe period C of the frame period 801. In the example of FIG. 3, the third scan line period combination includes odd can line periods, same as the first scan line period combination. The driving channel 121_1 and the driving channel 121_3 may output driving signals in the fourth scan line period combination of the subframe period C of the frame period 801, and the driving channel 121_2 and the driving channel 121_4 may not output driving signals in the fourth scan line period combination of the subframe period C of the frame period 801. In the example of FIG. 3, the fourth scan line period combination includes even scan line periods, same as the second scan line period combination. Therefore, by reducing a non-illuminating interval between two subframe periods in which a part of pixels of the pixel array (such as a checkerboard) are allowed to illuminate, the display refresh rate of the pixel array 200 may be increased, so as to effectively reduce the flicker phenomenon.

Figure 9:
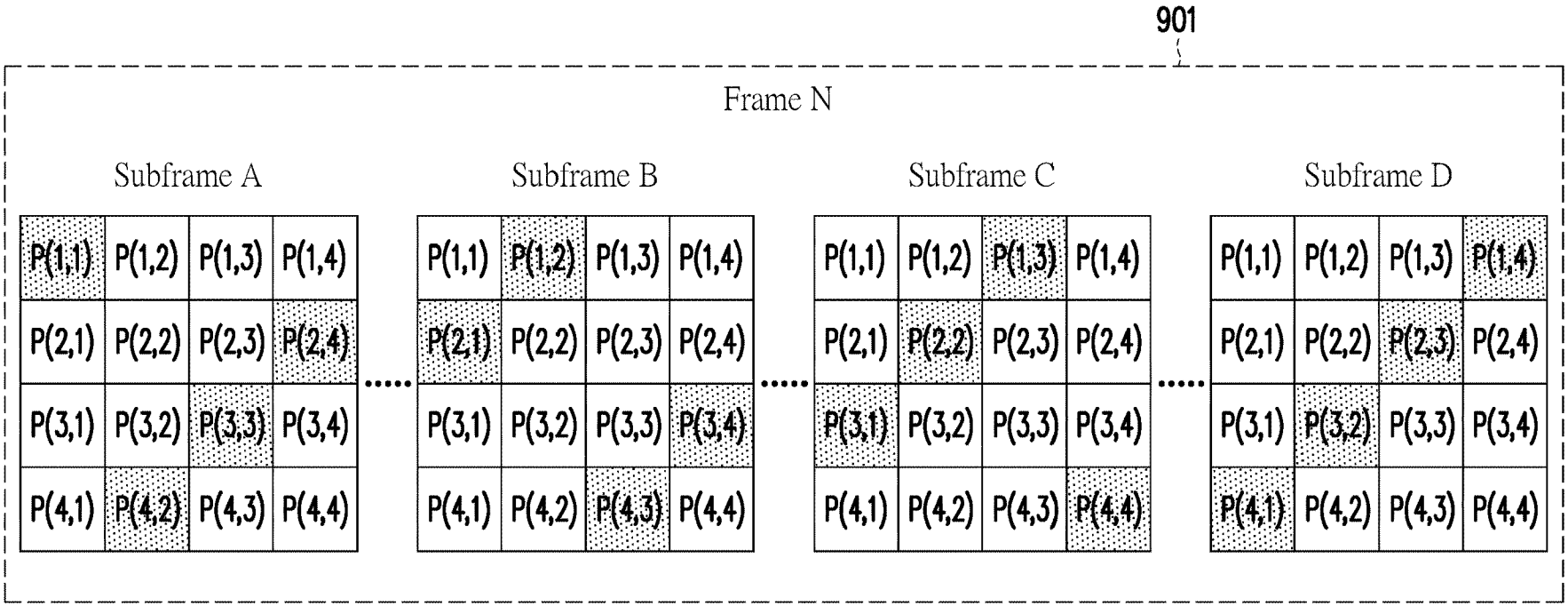
FIG. 9 is a schematic diagram of driving the pixel array of the display device during a plurality of subframe periods of the Nth frame period according to another embodiment of the disclosure.

FIG. 9 is a schematic diagram of driving the pixel array of the display device during a plurality of subframe periods of the Nth frame according to another embodiment of the disclosure. Referring to FIG. 1 and FIG. 9, different from the embodiment of FIG. 8, the driving channels output driving signals in different scan line period combinations respectively. In the embodiment of the disclosure, the driving channels 201_1~201_4, which are responsible for driving the first to fourth pixel columns, output driving signals in the four different scan line period combinations of each subframe period (subframe period A~D) of the frame period of the Nth frame period 901, and each driving channel outputs driving signals in four different scan line period combinations during the subframe periods of subframe period A~D of the frame period of the frame period 901. In FIG. 9, a first scan line period combination, in which the driving channel 121_1 is allowed to output driving signals, includes the (4n+1) scan line periods for n=0, 1, 2, 3, . . . ; a second scan line period combination in which the driving channel 121_2 is allowed to output driving signals, includes the (4n+4) scan line periods for n=0, 1, 2, 3, . . . ; a third scan line period combination in which the driving channel 121_3 is allowed to output driving signals, includes the (4n+3) scan line periods for n=0, 1, 2, 3, . . . ; and, a fourth scan line period combination in which the driving channel 121_4 is allowed to output driving signals, includes the (4n+2) scan line periods for n=0, 1, 2, 3, . . . . The total number of scan line periods is determined by the total number of pixel lines on the display panel. For any two driving channels driving adjacent pixel columns, the respective scan line period combinations for those two driving channels are different, and therefore, four subframe periods spaced with the same interval in a frame period may be used and. Therefore, by reducing a non-illuminating interval between two subframe periods in which a part of pixels of the pixel array are allowed to illuminate, the display refresh rate of the pixel array 200 may be increased, so as to effectively reduce the flicker phenomenon.

In summary, according to the display driver of the disclosure, the display driver can effectively drive pixel array of the display device during different subframe periods of each frame period according to different subframe period combination or different scan line period combination, so as to effectively reduce the time length of non-illuminating time interval between two subframe periods of one frame period. Therefore, the image flicker of the display device can be effectively reduced.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display driver for driving a display device comprising a pixel array, comprising:

a plurality of driving channels, outputting driving signals in a pulse width modulation manner to drive the pixel array to illuminate in a first frame period which is being divided into a plurality of subframe periods, wherein a first driving channel of the plurality of driving channels outputs a first driving signal in a first subframe period combination, wherein a second driving channel of the plurality of driving channels outputs a second driving signal in a second subframe period combination different than the first subframe period combination, wherein each of the first subframe period combination and the second subframe period combination comprises at least one subframe period of the first frame period.

2. The display driver according to claim 1, wherein each driving channel of the first driving channel and the second driving channel outputs a corresponding driving signal in each scan line period of each subframe period of a corresponding subframe period combination.

3. The display driver according to claim 1, wherein regarding to a pixel of the pixel array, the first driving channel responsible for driving the pixel outputs the first driving signal to the pixel in at least one subframe period of the first subframe period combination of the first frame period, and outputs the second driving signal to the pixel in at least one subframe period of the second subframe period combination of a second frame period different from the first frame period, and the first subframe period combination and the second subframe period combination include different frame periods.

4. The display driver according to claim 1, wherein regarding to a pixel of the pixel array, the first driving channel responsible for driving the pixel in the first frame period outputs the first driving signal to the pixel in the first subframe period combination consisting of only one subframe period.

5. The display driver according to claim 1, wherein regarding to a pixel of the pixel array, the first driving channel responsible for driving the pixel in the first frame period outputs the first driving signal to the pixel in the first subframe period combination consisting of two or more subframe periods, and wherein the entire pulse width of the first driving signal are being divided into partial pulse widths being respectively output in the two or more subframe periods of the first subframe period combination.

6. The display driver according to claim 5, wherein the two or more subframe periods of the first subframe period combination are alternately distributed in the first frame period.

7. The display driver according to claim 1, wherein the first driving channel outputs corresponding driving signals in some scan line periods of each of some subframe periods of the first subframe period combination, and outputs corresponding driving signals in other scan line periods of each of other subframe periods of the first subframe period combination.

8. The display driver according to claim 7, wherein the second driving channel is responsible for driving a second pixel column adjacent to a first pixel column driven by the first driving channel, and the second driving channel does not output any pulse with or partial pulse width of the second driving signal in scan line periods in which the first driving channel outputs the corresponding driving signals.

9. The display driver according to claim 1, further comprising a control circuit, wherein a driving channel, among of the plurality of driving channels, responsible for outputting the driving signal to a pixel of the pixel array, outputs the driving signal in a corresponding subframe period combination in response to the control circuit determines a pixel data of the pixel is lower than a predetermine grayscale value.

10. A display driver for driving a display device comprising a pixel array, comprising:

a plurality of driving channels, for outputting driving signals in a pulse width modulation manner to drive the pixel array to illuminate in a first frame period which is being divided into a plurality of subframe periods, wherein each of the plurality of subframe periods is being divided into a plurality of scan line periods, wherein a first driving channel of the plurality of driving channels outputs driving signals to pixels in a first scan line period combination of a first subframe period of the first frame period, and the first driving channel outputs driving signals in a second scan line period combination of a second subframe period of the first frame period, wherein a number of scan line periods of the first scan line period combination or the second scan line period combination is less a number of the plurality of scan line periods, wherein each of the first scan line period combination and the second scan line period combination comprises at least one scan line period.

11. The display driver according to claim 10, wherein a second driving channel of the plurality of driving channels, which is responsible for driving a second pixel column adjacent to a first pixel column driven by the first driving channel, outputs driving signals in the first scan line period combination of the first subframe period of the first frame period, and the second driving channel outputs driving signals in the second scan line period combination of the second subframe period of the first frame period.

12. The display driver according to claim 10, wherein a second driving channel of the plurality of driving channels, which is responsible for driving a second pixel column adjacent to a first pixel column driven by the first driving channel, outputs driving signals in a third scan line period combination, different from the first scan line period combination, of the first subframe period of the first frame period, and the second driving channel outputs driving signals in fourth scan line period combination, different from the second scan line period combination, of the second subframe period of the first frame period.

13. The display driver according to claim 12, wherein the second driving channel of the plurality of driving channels does not output driving signals in the first scan line period combination of the first subframe period of the first frame period, and the second driving channel does not outputs driving signals in the second scan line period combination of the second subframe period of the first frame period.

14. The display driver according to claim 10, wherein a second driving channel of the plurality of driving channel, which is responsible for driving a second pixel column adjacent to a first pixel column driven by the first driving channel, outputs driving signals in a third scan line period combination of a third subframe period of the first frame period, and the second driving channel outputs driving signals in a fourth scan line period combination of a fourth subframe period of the first frame period.

15. The display driver according to claim 10, further comprising a control circuit, wherein a driving channel, among of the plurality of driving channels, responsible for outputting a driving signal to a pixel of the pixel array, outputs the driving signal in a corresponding subframe period combination in response to the control circuit determines a pixel data of the pixel is lower than a predetermine grayscale value.

* * * * *